US006698839B2

(12) United States Patent
Ballendat

(10) Patent No.: US 6,698,839 B2
(45) Date of Patent: Mar. 2, 2004

(54) BACK OF CHAIR

(75) Inventor: Martin Ballendat, Altheim (AT)

(73) Assignee: Dauphin Entwicklungs-u. Beteiligungs-GmbH, Neukirchen (DE)

( * ) Notice: Subject to any disclaimer, the term of this patent is extended or adjusted under 35 U.S.C. 154(b) by 0 days.

(21) Appl. No.: 10/261,621

(22) Filed: Oct. 2, 2002

(65) Prior Publication Data

US 2003/0062756 A1 Apr. 3, 2003

(30) Foreign Application Priority Data

Oct. 2, 2001 (DE) ..... 101 48 645

(51) Int. Cl.[7] ..... A47C 7/40

(52) U.S. Cl. ..... 297/440.11; 297/218.4; 297/440.1; 297/452.18

(58) Field of Search ..... 297/218.4, 226, 297/228.1, 440.1, 440.11, 440.2, 452.18, 452.58

(56) References Cited

U.S. PATENT DOCUMENTS

| | | | | |
|---|---|---|---|---|
| 2,722,967 A | | 11/1955 | Reinholz | |
| 3,759,572 A | | 9/1973 | Koepke | |
| 4,577,901 A | | 3/1986 | Phillips | |
| 4,583,783 A | * | 4/1986 | Kanai | 297/452.56 |
| 4,592,126 A | * | 6/1986 | Bottemiller | 29/446 |
| 4,614,377 A | | 9/1986 | Luo | |
| 4,660,884 A | * | 4/1987 | Terui et al. | 297/317 |
| 4,784,436 A | * | 11/1988 | Sutherland | 297/440.24 |
| 4,890,882 A | * | 1/1990 | Harrington | 297/45 |
| 5,013,089 A | * | 5/1991 | Abu-Isa et al. | 297/452.64 |
| 5,393,126 A | * | 2/1995 | Boulva | 297/452.56 |
| 5,498,054 A | * | 3/1996 | Tomlinson | 297/16.2 |

FOREIGN PATENT DOCUMENTS

| | | |
|---|---|---|
| DE | 75 29 149 | 1/1976 |
| DE | 197 54 817 | 6/1999 |

* cited by examiner

*Primary Examiner*—Peter R. Brown
(74) *Attorney, Agent, or Firm*—Browdy and Neimark, P.L.L.C.

(57) ABSTRACT

A back comprises a frame formed by two c-shaped frame parts. These are inserted into circumferentially extending rand seams of a cover to which purpose at least one insertion opening is formed in one rand seam. The connection between said two frame parts is achieved by connecting members which further cover up the at least one insertion opening.

10 Claims, 5 Drawing Sheets

FIG. 3
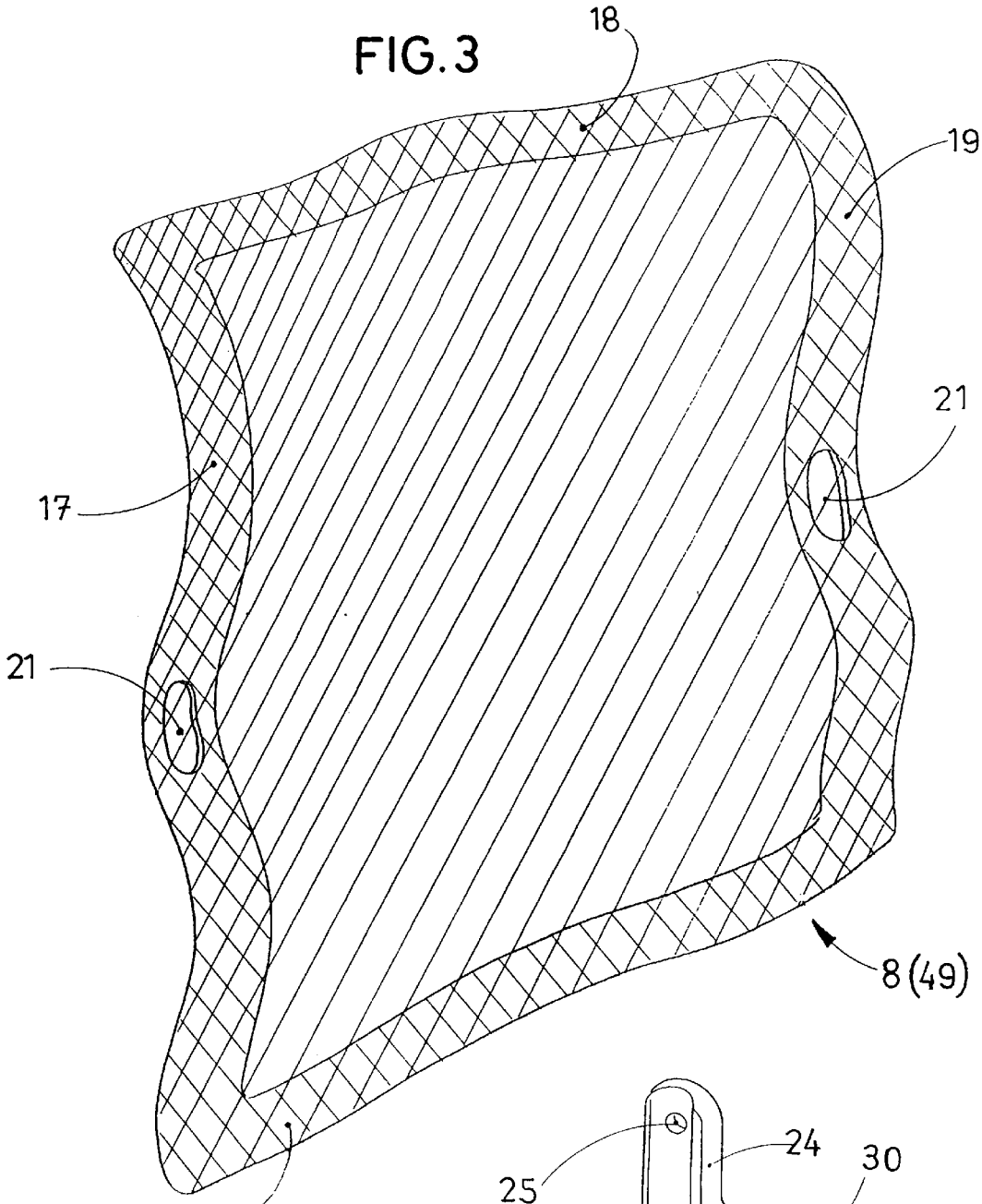
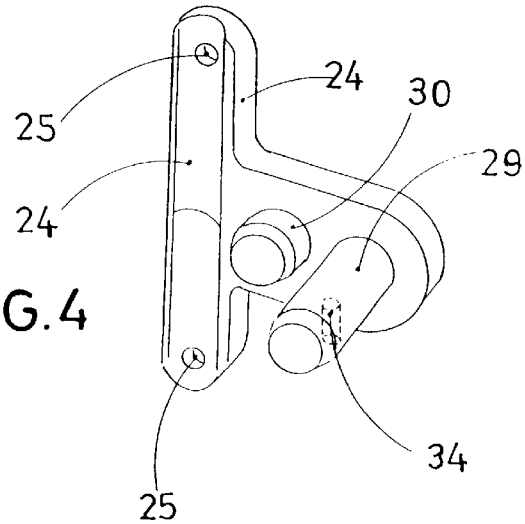
FIG. 4

18
47
49
54
52
17
19
20
44
53
40
42
43
41

BACK OF CHAIR

BACKGROUND OF THE INVENTION

1. Field of the Invention

The present invention relates to a back of a chair.

2. Background Art

Backs having a back frame are known which comprise a U-shaped lower frame part and a plastic bow serving as upper end part. The cover comprises two lateral rand seams or hollow seams which are pushed onto the essentially perpendicular lateral legs of the lower frame part. The cover is secured onto the lower frame part by means of securing pins. On said cover, a central upper bracket is formed which is attached in the upper end bow and tensioned.

Furthermore, a back having a back frame is known, said back frame comprising two lateral pipe-shaped stanchions and an upper and a lower transversal stanchion made of flat steel. The lateral stanchions are made of an aluminum profile comprising an undercut longitudinal groove into which rand bars are inserted which are attached onto the side edges of a cover. The cover comprises at its upper and lower edges rand seams into which flat steel stanchions are inserted. Thereafter, the frame is assembled by screws.

These known structures require an extraordinarily expensive assembly.

DE 197 54 817 A1 describes a back comprising a frame shaped like a reversed letter U being open towards the bottom. The legs of said frame are connected in an articulated manner to the upper transversal stanchion. The cover used is formed in the shape of a sack. The articulated frame is inserted into the cover by swaying the stanchion and one leg accordingly and expanding it with the cover being tensioned. The free lower ends of the frame legs are then attached to the chair.

SUMMARY OF THE INVENTION

It is an object of the present invention to provide a back for a chair which is easy to assemble and allows an even tension of the cover in all directions.

According to the present invention, this object is achieved in a back of a chair, comprising: a back frame comprising a first and a second frame part each being C-shaped and having two legs and a bar, said frame parts being joined with each other on the free ends of said legs on connecting locations; a cover, comprising four rand seams for receiving said legs and said bar of the first and the second frame parts, at least one insertion opening in a rand seam on a joint location of said frame parts; and two connecting members by means of which said frame parts are connected with each other at the joint locations, and at least one of which covers said at least one insertion opening. The solution according to the present invention results in the fact that the frame parts can be inserted into a rand seam of the pre-fabricated cover through a relatively small opening. The assembly of the two frame parts to form a frame is very simple. The opening formed in the cover is optically hidden completely when the two frame parts are fixed relative to each other.

Further features, advantages and details of the invention will become clear from the following description of two example embodiments with reference to the drawings.

BRIEF DESCRIPTION OF THE DRAWINGS

FIG. 3 shows the cover for the back shown in FIGS. 1 and 2, FIG. 4 shows a connecting member for the frame shown in FIG. 2.

DESCRIPTION OF THE PREFERRED EMBODIMENTS

Figure 1:
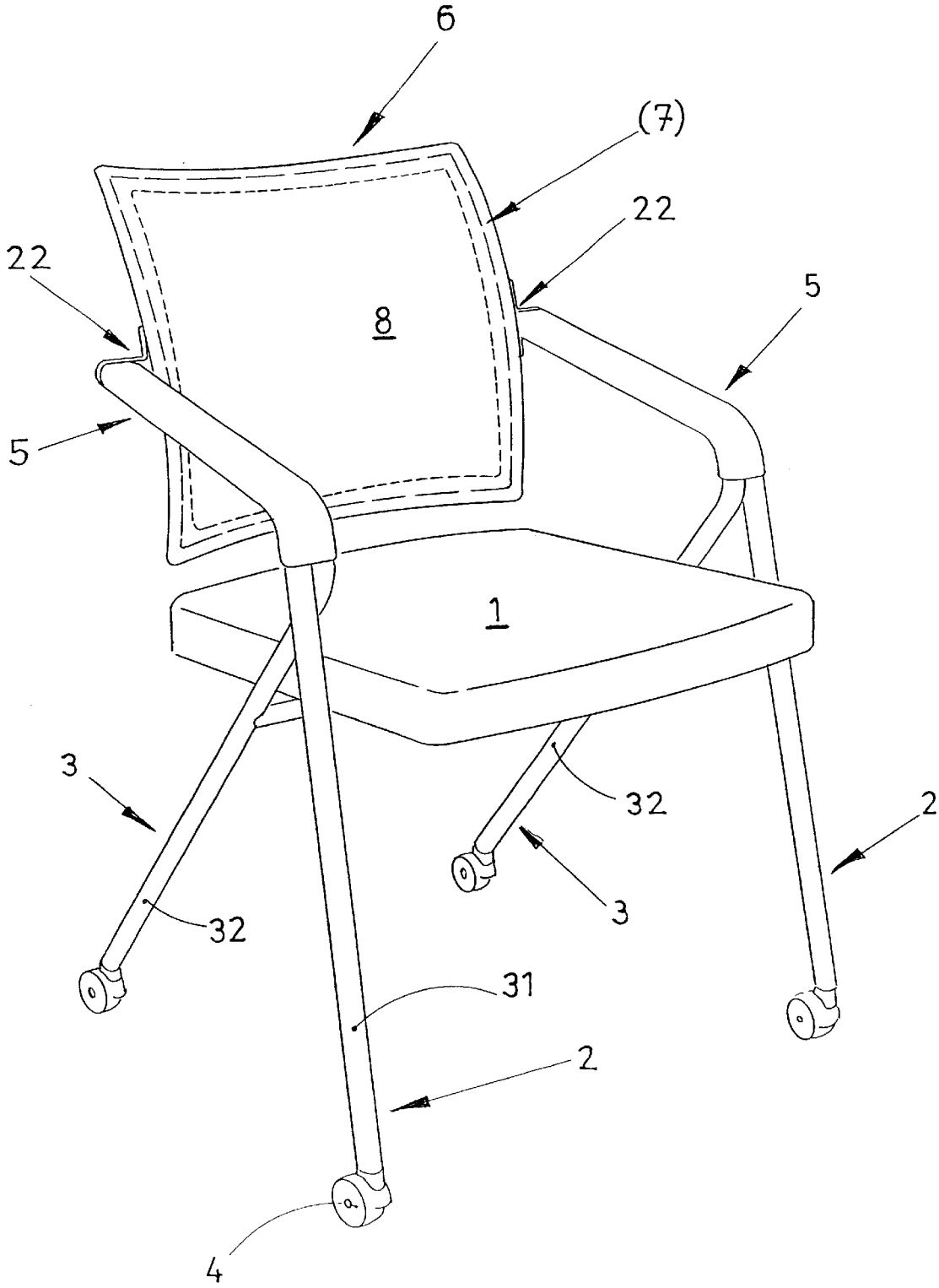
FIG. 1 shows a chair comprising a back according to a first embodiment of the present invention.

The chair shown in FIG. 1 comprises a seat 1 supported on the floor by means of chair legs 2, 3 being arranged symmetrically to each other and having chair rollers 4. Said chair legs 2, 3 are each linked to each other in pairs to form an arm rest 5. Onto the rear ends of said arm rests 5, a back 6 is attached comprising a rectangular, and in particular square, back frame 7 provided with a cover 8.

Figure 2:
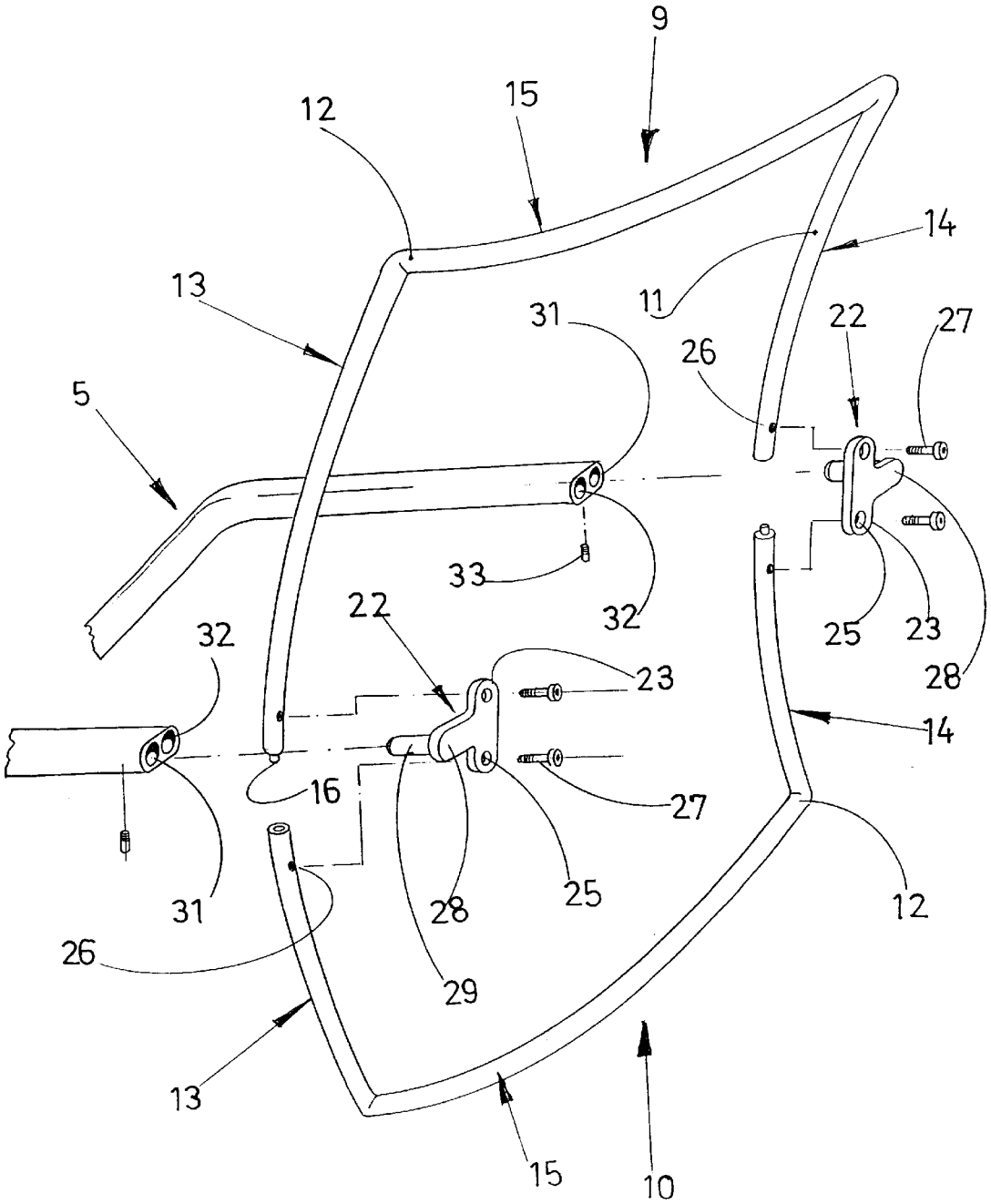
FIG. 2 shows an exploded view of the frame of the back of the chair shown in FIG. 1.

As shown in FIG. 2, said frame 7 consists of two essentially similar C-shaped frame parts 9, 10 made of metal tubes 11 joined with each other by welding at the corners 12 between one leg 13 or 14, respectively, and a bar 15. Said two frame parts 9, 10 are connected to each other at the free ends of their legs 13, 14 as shown in the exploded view of FIG. 2. For centering, a centering pin 16 is attached to the end of one leg 13 or 14, respectively, to be inserted into the respective end of the leg 13 or 14, respectively, being flush with it.

Said frame 7 to be formed by said two frame parts 9, 10 is provided with a cover 8 shown in FIG. 3. Said cover 8 comprises at each of its four longitudinal sides assigned to said bars 15 and said legs 13, 14 a hollow rand seam 17, 18, 19, 20, i.e. a hose-shaped hollow seam. Said cover 8 is made of a knitwear made of natural and/or plastic and/or metal yarn or a suitable mixture of such yams. It may also be manufactured of a fabric having sufficient flexibility. Said rand seams 17 through 20 may be formed during the knitting process or be formed afterwards by sewing or the like. In the center of each of said rand seams 17, 19 receiving said legs 13, 14 of said two frame parts 9, 10, a small insertion opening 21 is formed, respectively, through which one frame part 9, 10, respectively, is inserted. Due to the flexibility of said cover 8 and a sufficient width of said rand seams 17 through 20 compared with the width of said tubes 11, said frame parts 9, 10 can be inserted. Said cover 8 is tensioned by engaging said legs 13, 14 with each other by means of said centering pins 16. The joints of said legs 13, 14 of said frame parts 9, 10 are located in the place of said openings 21.

The connection of said back 6 being pre-assembled as described above to said arm rests 5 of the chairs is implemented by connecting members 22 which are shown in particular in FIG. 4. Said connecting members 22 forming part of said back 6 are formed in a T-shape. Its end bar 23 to be arranged perpendicularly comprises an inner surface 24 adapted to the curve of said tubes 11. Further, it comprises two bores 25 being flush with two bores 26 formed in said legs 13, 14 of said frame parts 9, 10 when the latter are joined abut with each other as described above. Screws 27 are inserted into said bores 25 and screwed into said bores 26. By doing so, said two frame parts 9, 10 are tightly connected with each other and with said connecting members 22. Further, the end bar 23 of each connecting member 22 covers the respective opening 21 formed in said rand seam 17, 19 of said cover 8 so that said opening 21 becomes invisible from outside.

The respective central bar 28 of each connecting member 22 comprises two supporting pins 29, 30 projecting towards each other in parallel for engagement into the two open ends of the two tubes 31, 32 forming the chair legs 2, 3 and being joined to form an arm rest 5. Said connecting members 22 are fixed to said tubes 31, 32 by means of a screw 33, respectively, which is screwed from beneath through the respective outermost tube 31 into a bore 34 in the longer supporting pin 29. This connection bears the leaning force exerted by the user of the chair onto said back 6.

The back frame 7 is formed as an arc, i.e. the horizontal bars 15 are—viewed from said seat 1—bent to the rear while the perpendicular legs 13, 14 are bent towards said seat 1.

Figure 5:
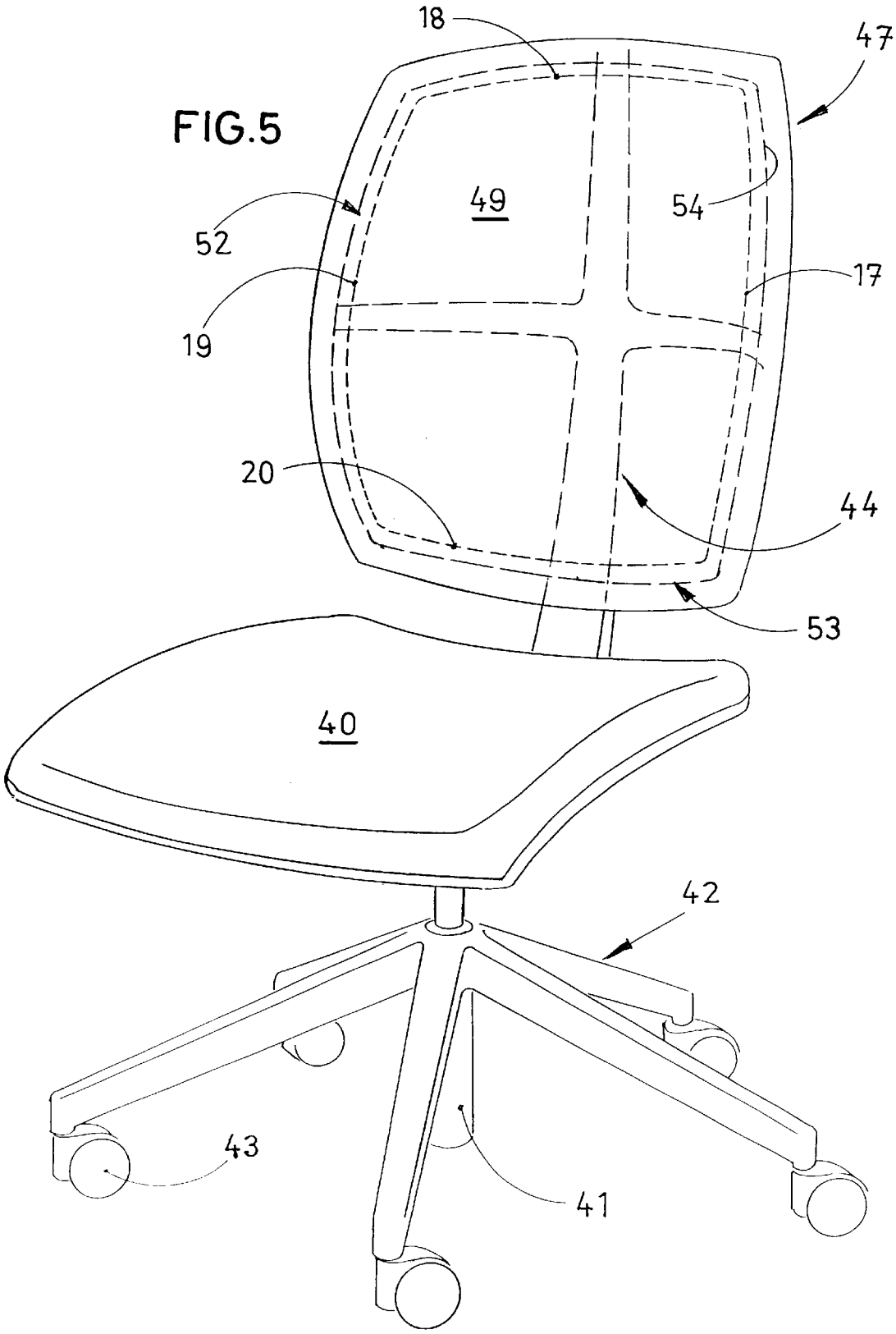
FIG. 5 shows a chair comprising a second embodiment of a back according to the present invention.

The chair shown in FIG. 5 is an office chair the seat 40 of which is mounted on a seat support (not shown) which is attached via a lengthwise adjustable chair column 41 to a foot cross 42 which is supported by chair rollers 43 on the floor. To the seat support, a back support 44 is attached which extends upward behind said seat 40. It has a cross shape, i.e. it comprises a central bar 45 essentially extending upward and a transverse bar 46 extending essentially in a horizontal direction. Both bars 45, 46 are bent towards their ends directed to said seat 40, i.e. they are concave when viewed from said seat 40 or convex when viewed from the rear side.

Onto said back support 44, a part of a back 47 is attached which—as in the example embodiment described above—comprises a rectangular, in particular an essentially square back frame 48 provided with a cover 49 formed in the same way as said cover 8 described above and shown in FIG. 3 so that reference can be made to the respective description.

Said frame 48, too, consists of two C-shaped frame parts 50, 51, the legs 52, 53 of which are arranged horizontally in this example embodiment while the bars 54 are arranged perpendicularly. Said legs 52, 53 comprise at their free ends flange bars 55, 56 facing each other which are aligned in pairs with each other and then have the same cross-section as said legs 52, 53. They each comprise two bores 57 which flush with each other when both bars 55, 56 are laid on each other and which can be brought into coverage with bores 58 formed in support bearings 59, 60 of said central bar 45. Also, in the end of said transverse bar 46, bores 61 are formed which flush with one bore 62, respectively, provided in the center of the respective bar 54 when said frame 48 is in contact with said back support 44.

In this embodiment, said frame parts 50, 51 are not made of metal tubes but of extruded, fiber-reinforced plastic such as plastic reinforced with graphite fibers.

As described above, the assembly is done by firstly inserting a leg 52 and then said bar 54 followed by the other leg 53 of one frame part 50 or 51, respectively, through an insertion opening 21 of said cover 49 into said rand seams 17, 18, 19 and then the other frame part 51 in the same manner into said rand seams 17, 20, 19. Here, too, said rand seams 17 through 20 are wider than said legs 52, 53 and said bars 54 in order to allow insertion. Following this, said flange bars 54, 55 cover said openings 21 of said cover 49. For facilitating the assembly, said frame parts 50, 51 are stabilized against each other by pushing an assembly supporting pin (not shown) through central centering bores 63 of said flange bars 55, 56. Thereafter, said back 47 which has been pre-assembled in this manner is laid against said support bearings 59, 60 which serve as connecting members, followed by mounting said frame 48 with said cover 49 onto said central bar 45 by screwing screws 64 through said bores 58 in said support bearings 59, 60 into said bores 57 of said flange bars 55, 56 lying on top of each other, thus also achieving a fixed joint between said frame parts 50, 51. For stabilizing said back 47, screws 65 are also screwed through said bores 61 in said transversal bar 46 into said bores 62 formed in said bars 54.

Figure 6:
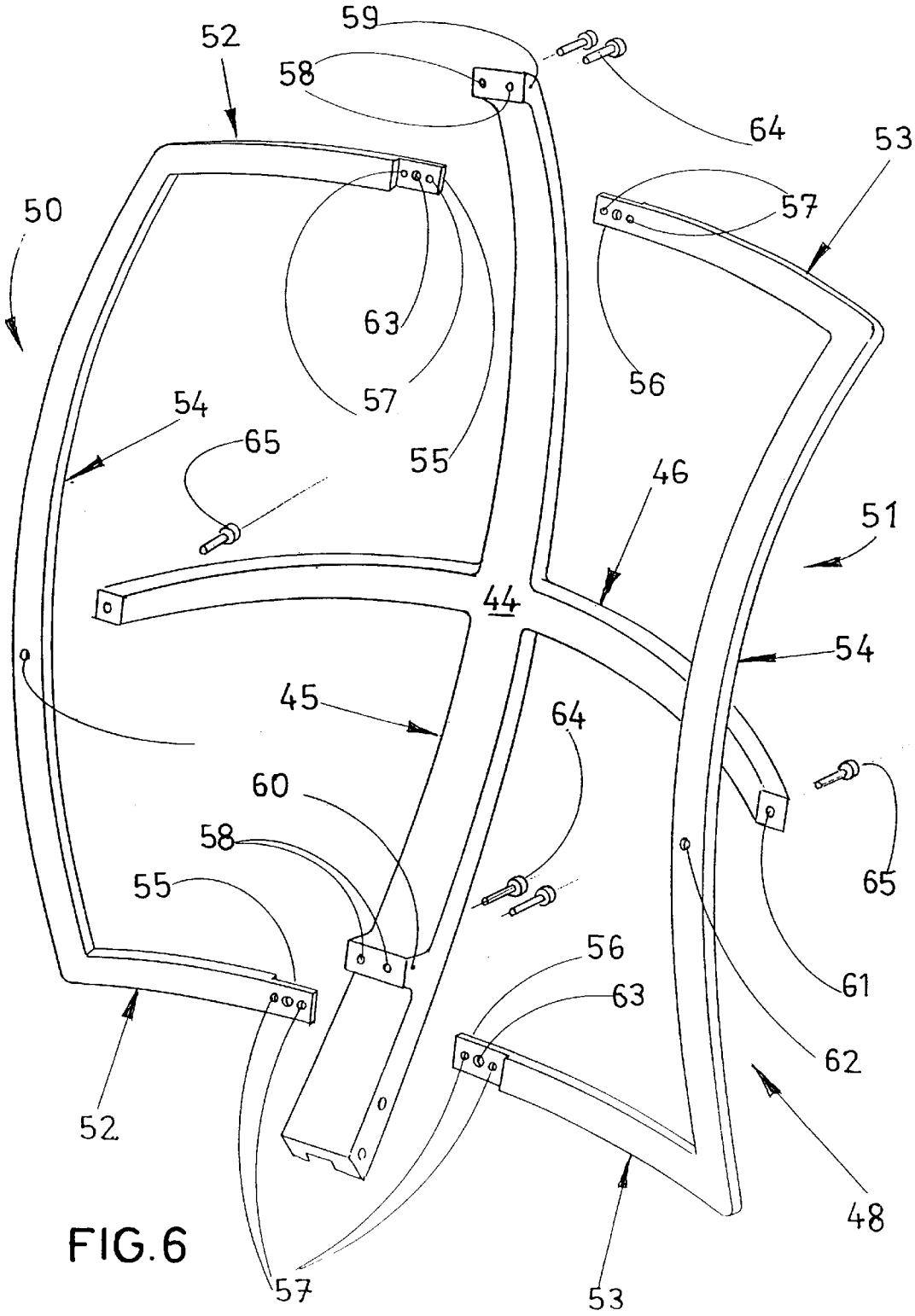
FIG. 6 shows an exploded view of the frame of the back of the chair shown in FIG. 5.

In this embodiment, too, said openings 21 of said cover 49 are completely covered by said support bearings 59, 60 so as to become invisible. Said screws 65 are screwed through said cover 49; no openings need to be provided for them in the cover. In the example embodiment shown in FIGS. 5 and 6, too, said back frame 48 may be arched in its entirety, i.e. said horizontal legs 52, 53 are bent rearwards to said back support 44 while said perpendicular bars 54 are bent towards the seat 40.

What is claimed is:

1. A back of a chair, comprising:

a back frame (7) comprising a first and a second frame part (9, 10; 50, 51) each being C-shaped and having two legs (13, 14; 52, 53) and a bar (15; 54), said frame parts being joined with each other on the free ends of said legs (13, 14; 52, 53) on connecting locations;

a cover (8; 49), comprising:

four rand seams (17 through 20) for receiving said legs (13, 14; 52, 53) and said bar (15; 54) of the first and the second frame parts (9, 10; 50, 51), at least one insertion opening (21) in a rand seam (17) on a joint location of said frame parts (9, 10; 50, 51); and two connecting members (22; 59, 60)

by means of which said frame parts (9, 10; 50, 51) are connected with each other at the joint locations, and at least one of which covers said at least one insertion opening (21).

2. A back according to claim 1, wherein two insertion openings (21) are provided at the joint locations and each being covered by a connecting member (22; 59, 60).

3. A back according to claim 2, wherein said connecting members (22; 59, 60) are formed as parts allowing their being connected with a chair.

4. A back according to claim 3, wherein said connecting members (22) are formed on a back support (44) as support bearings (59, 60) for said back frame (48).

5. A back according to claim 4, wherein said legs (52, 53) of said frame parts (50, 51) are arranged horizontally while said bars (54) are arranged perpendicularly.

6. A back according to claim 2, wherein said connecting members (22) are formed as parts allowing their being connected with arm rests (5) of a chair.

7. A back according to claim 2, wherein said connecting members (22) are provided with at least one supporting pin (29, 30) for providing a connection with at least one tube (31, 32) of a chair.

8. A back according to claim 2, wherein said legs (13, 14) of said frame parts (9, 10) are arranged perpendicularly while said bars (13) are arranged horizontally.

9. A back according to claim 1, wherein said frame parts (9, 10) are made of metal tubes (11).

10. A back according to claim 1, wherein said frame parts (50, 51) are made of fiber-reinforced plastic.

* * * * *